United States Patent [19]

Zoltner

[11] Patent Number: 5,046,419

[45] Date of Patent: Sep. 10, 1991

[54] ROTARY INK STAMP FOR A COPIER/PRINTER APPARATUS

[75] Inventor: John D. Zoltner, Rochester, N.Y.

[73] Assignee: Xerox Corporation, Stamford, Conn.

[21] Appl. No.: 275,488

[22] Filed: Nov. 23, 1988

Related U.S. Application Data

[63] Continuation-in-part of Ser. No. 105,074, Oct. 5, 1987, abandoned.

[51] Int. Cl.[5] ..... B41F 13/24

[52] U.S. Cl. ..... 101/235; 101/328; 101/377

[58] Field of Search ..... 101/233, 234, 235, 236, 101/237, 245, 212, 5, DIG. 3, 328, 377

[56] References Cited

U.S. PATENT DOCUMENTS

| | | | |
|---|---|---|---|
| 1,032,378 | 7/1912 | Chandler | 101/236 |
| 1,290,509 | 1/1919 | Chandler | 101/236 |
| 1,983,921 | 12/1934 | Persson | 101/235 |
| 2,743,671 | 5/1956 | Weber et al. | 101/235 |
| 2,746,380 | 5/1956 | Gottscho | 101/235 X |
| 2,934,009 | 4/1960 | Bach et al. | 101/235 |
| 3,162,118 | 12/1964 | Martensson et al. | 101/245 X |
| 3,186,337 | 6/1965 | Hill | 101/377 X |
| 3,245,343 | 4/1966 | Walter | 101/235 |
| 4,632,533 | 12/1986 | Young | 355/3 SH |

*Primary Examiner*—Edgar S. Burr
*Assistant Examiner*—Moshe I. Cohen
*Attorney, Agent, or Firm*—William A. Henry, II

[57] ABSTRACT

A rotary stamp mechanism includes a drive wheel with a curved stamp holding housing held thereon by a sheet metal band to enable replacement and adjustment of the stamp housing. A stamping sequence is selected by a machine operator and the leading edge of the next succeeding copy sheet triggers rotation of the drive wheel and during one complete revolution of the drive wheel the copy sheet is stamped with a desired logo. A pawl on the drive wheel is lifted by the copy sheet for stamping purposes and gravity returns the pawl to its home position which in turn stops the drive wheel in its initial position for succeeding stamping.

15 Claims, 3 Drawing Sheets

ROTARY INK STAMP FOR A COPIER/PRINTER APPARATUS

This application is a continuation-in-part of pending U.S. application Ser. No. 07/105,074, filed Oct. 5, 1987, now abandoned and is incorporated herein by reference.

This invention relates generally to an electrophotographic printing machine, and more particularly concerns a rotary ink stamp device for use in such machines.

A need has been shown by copying customers in the past for the ability to be able to automatically stamp a colored ink impression on copies, e.g., "Private Data", "Personal", "Copy", "Rush", etc. for special handling purposes. One known device for accomplishing this is used with the Xerox 2080 printer. However, this device is complex and expensive and designed to operate effectively in the paper tray of the printer at low process speeds. It does not answer the need for a simple, low cost and generic stamper device for high speed machines.

Various other approaches to printing ink on paper are available, including those in U.S. Pat. Nos. 2,743,671; 2,934,009; and 3,245,343. The pertinent portions of the foregoing disclosures may be summarized as follows:

The '671 patent to Weber et al. discloses a sheet tripped endorsing machine that includes a stop pawl which is retractable to free a shaft for rotation by a friction clutch mechanism. Withdrawal of the stop pawl is effected by a solenoid.

Bach et al. in the '009 patent shows a rotary feeding and treating mechanism that includes a rockable trip finger and a stop lever. The trip finger can assume a position to clear a path for an incoming work piece allowing the work piece to advance to a printing drum.

In the '343 patent, Walther discloses an article tripped rotary printing machine that has a rotatable wheel with a stamping block and a stop. The stamping procedure is initiated when an object to be stamped is moved through a passageway.

In accordance with one aspect of the present invention, a rotary stamp mechanism is disclosed that comprises a drive wheel with a curved stamp holding housing held thereon by a sheet metal or molded plastic band to enable replacement and adjustment of the stamp housing. A stamping sequence is selected by a machine operator and the leading edge of the next succeeding copy sheet triggers rotation of the drive wheel and during one complete revolution of the drive wheel the copy sheet is stamped with the desired logo. A pawl on the drive wheel is lifted by the copy sheet for stamping purposes and gravity returns the pawl to its home position which in turn stops the drive wheel in its initial position for succeeding stamping.

In accordance with an alternative aspect of the present invention, there is provided a rotary stamp mechanism that is triggered by the lead edge of a copy sheet and deactivated by the trail edge of the copy sheet. This stamp mechanism utilizes an inking system that is mounted in a circular carrier which in turn mates with a drive wheel. Rotating one relative to the other provides stamp registration across a copy sheet. A pawl on the drive wheel is lifted by the copy sheet for stamping purposes and gravity returns the pawl to its home position.

Other aspects of the present invention will become apparent as the following description proceeds and upon reference to the drawings, in which.

While the present invention will hereinafter be described in connection with preferred embodiments thereof, it will be understood that there is no intention to limit the invention to those embodiments. On the contrary, all alternatives, modifications and equivalents as may be included within the spirit and scope of the invention as defined by the appended claims are intended to be covered.

Figure 1:
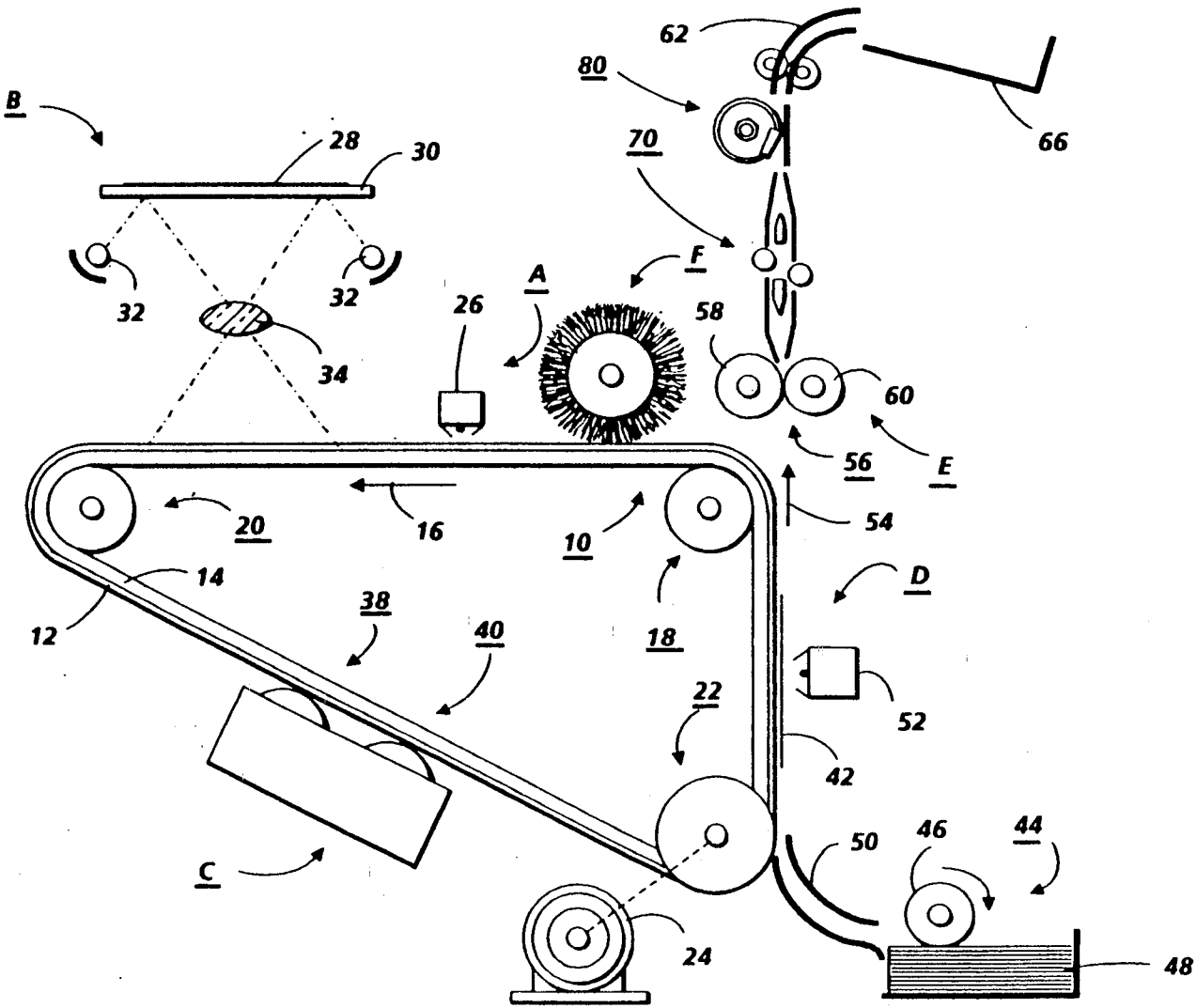
FIG. 1 is an elevational view illustrating schematically in electrophotographic printing machine incorporating the features of the present invention therein.

For a general understanding of the features of the present invention, reference is made to the drawings. In the drawings like reference numerals have been used throughout to designate identical elements. FIG. 1 schematically depicts the various components of an illustrative electrophotographic printing machine incorporating the rotary ink stamping apparatus of the present invention therein in accordance with one aspect thereof. It will become evident from the following discussion that the ink stamping apparatus is equally well suited for use in a wide variety of printing machines and is not necessarily limited in its application to the particular embodiments shown herein.

Inasmuch as the art of electrophotographic printing is well known, the various processing stations employed in the FIG. 1 printing machine will be shown hereinafter schematically and their operation described briefly with reference thereto.

As shown in FIG. 1, the electrophotographic printing machine as disclosed in U.S. Pat. No. 4,632,533 employs a belt 10 having a photoconductive surface 12 deposited on a conductive substrate 14. Preferably, photoconductive surface 12 comprises a transport layer having small molecules of m-TBD dispersed in a polycarbonate and a generation layer of trigonal selenium. Conductive substrate 14 is made preferably from aluminized Mylar which is electrically grounded. Belt 10 moves in the direction of arrow 16 to advance successive portions of photoconductive surface 12 through the various processing stations disposed about the path of movement thereof. Belt 10 is entrained about stripping roller 18, tension roller 20, and drive roller 22. Drive roller 22 is mounted rotatably and in engagement with belt 10. Roller 22 is coupled to motor 24 by suitable means such as a belt drive. Motor 24 rotates roller 22 to advance belt 10 in the direction of arrow 16. Drive roller 22 includes a pair of opposed, spaced edge guides. The edge guides define a space therebetween which determines the desired path of movement of belt 10. Belt 10 is maintained in tension by a pair of springs (not shown) resiliently urging tension roller 20 against belt 10 with the desired spring force. Both stripping roller 18 and tension roller 20 are mounted to rotate freely.

With continued reference to FIG. 1, initially a portion of belt 10 passes through charging station A. At charging station A, a corona generating device, indicated generally by the reference numeral 26, charges photoconductive surface 12 to a relatively high, substantially uniform potential.

Thereafter, the charged portion of the photoconductive surface 12 is advanced through exposure station B. At exposure station B, an original document 28 is positioned face-down upon transparent platen 30. Lamps 32 flash light rays onto original document 28. The light rays reflected from original document 28 are transmitted through lens 34 forming a light image thereof. Lens 34 focuses the light image onto the charged portion of photoconductive surface 12 to selectively dissipate the charge thereon. This records an electrostatic latent image on photoconductive surface 12 which corresponds to the informational areas contained within original document 28.

Next, belt 10 advances the electrostatic latent image recorded on photoconductive surface 12 to development station C. At development station C, a magnetic brush development system, indicated generally by the reference numeral 36, transports a developer material into contact with photoconductive surface 12. Preferably, the developer material comprises carrier granules having toner particles adhering triboelectrically thereto. Magnetic brush system 36 preferably includes two magnetic brush developer rollers 38 and 40. These developer rollers each advance the developer material into contact with the photoconductive surface 12. Each developer roller forms a chain-like array of developer material extending outwardly therefrom. The toner particles are attached from the carrier granules to the electrostatic latent image forming a toner powder image on photoconductive surface 12 of belt 10.

Belt 10 then advances the toner powder image to transfer station D. At transfer station D, a sheet of support material 42 is moved into contact with the toner powder image. The sheet of support material is advanced to transfer station D by a sheet feeding apparatus 44. Preferably, a sheet feeding apparatus 44 includes a feed roll 46 contacting the uppermost sheet of stack 48. Feed roll 46 rotates to advance the uppermost sheet from stack 48 into chute 50. Chute 50 directs the advancing sheet of support material into contact with photoconductive surface 12 in registration with the toner powder image developed thereon. In this way, the toner powder image contacts the advancing sheet of support material at transfer station D.

Transfer station D includes a corona generating device 52 which sprays ions onto the backside of sheet 42. This attracts the toner powder image from photoconductive surface 12 to sheet 42. After transfer, the sheet continues to move in the direction of arrow 54 onto a conveyor (not shown) which advances the sheet to fusing station E.

Fusing station E includes a fuser assembly, indicated generally by the reference numeral 56, which permanently affixes the transferred toner powder image to sheet 42. Preferably, a fuser assembly 56 includes a heated fuser roller 58 and a back-up roller 60. Sheet 42 passes between fuser roller 58 and back-up roller 60 with the toner powder image contacting fuser roller 58. In this manner, the toner powder image is heated so as to be permanently affixed to sheet 42. After fusing, sheet 42 is advanced to the decurling apparatus, indicated generally by the reference numeral 70. At this time, the sheet of support material has undergone numerous processes and very frequently contains undesired curls therein. This may be due to the various processes through which it has been subjected, or to the inherent nature of the sheet material itself. The apparatus bends the sheet of support material so that the sheet material is strained to exhibit plastic characteristics. After passing through decurling apparatus 70, the sheet of support material is advanced past the stamping apparatus 80 of the present invention to be either stamped or not stamped and thereafter directed into catch tray 66 for subsequent removal from the printing machine by the operator.

Invariably, after the sheet of support material is separated from photoconductive surface 12 of belt 10, some residual particles remain adhering thereto. These residual particles are removed from photoconductive surface 12 at cleaning station F. Cleaning station F includes a pre-clean corona generating device (not shown) and a rotatably mounted fiberous brush 68 in contact with photoconductive surface 12. The pre-clean corona generating device neutralizes the charge attracting the particles to the photoconductive surface. The particles are then cleaned from photoconductive surface 12 by the rotation of brush 68 in contact therewith. Subsequent to cleaning, a discharge lamp (not shown) floods photoconductive surface 12 with light to dissipate any residual electrostatic charge remaining thereon prior to the charging thereof for the next successive image cycle.

It is believed that the foregoing description is sufficient for purposes of the present application to illustrate the general operation of an electrophotographic printing machine incorporating the features of the present invention therein.

Figure 2:
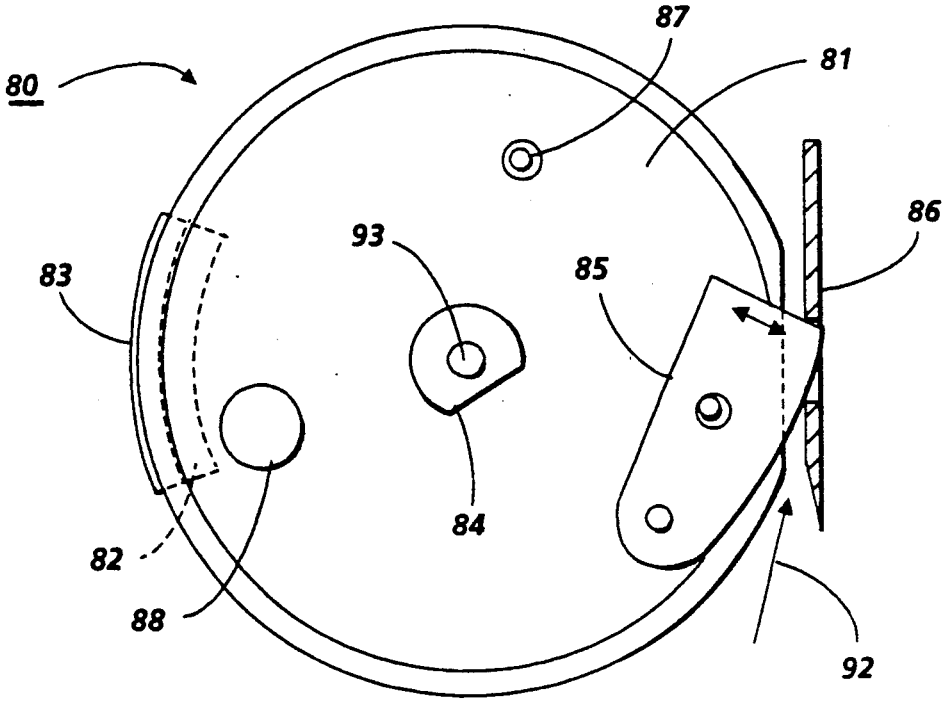
FIG. 2 is an enlarged side view of the rotary ink stamping apparatus of the present invention used in the printing machine of FIG. 1.
Figure 3:
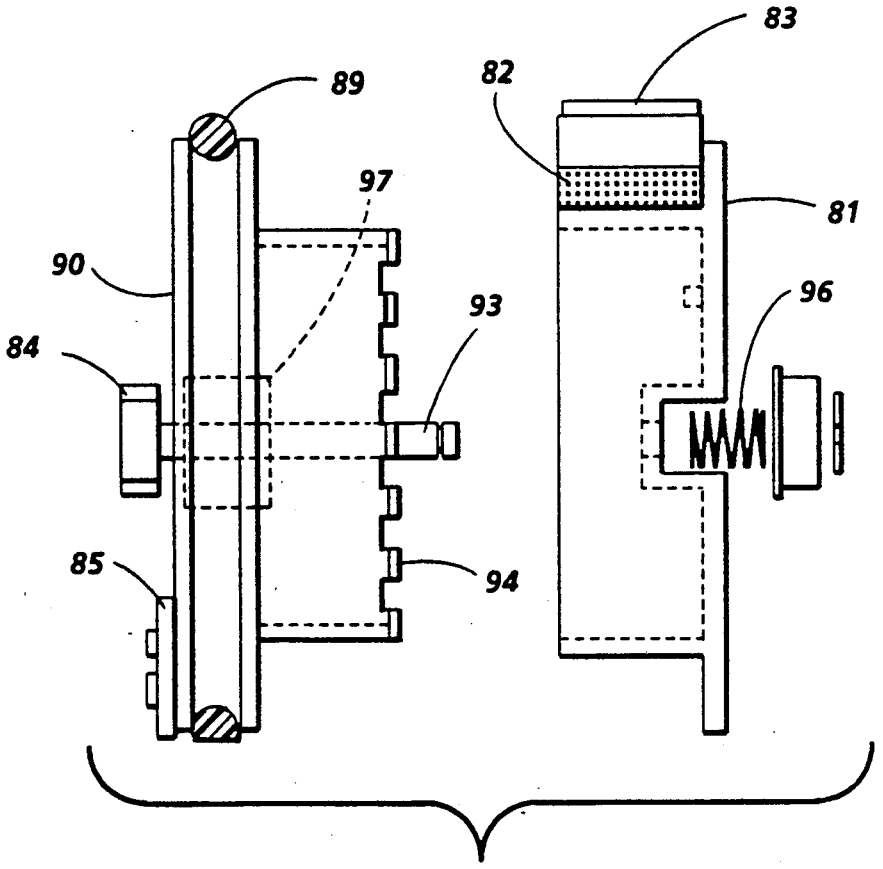
FIG. 3 is a front view of the rotary inking apparatus of FIG. 2 that has been separated into two halves.

Referring now to the subject matter of one aspect of the present invention, FIGS. 2 and 3 depict an embodiment 80 of the rotary stamping apparatus of the present invention in detail. The stamping apparatus or print wheel 80 features circular carrier 81 that is mated to a drive wheel 90. Drive wheel 90 is mounted on a shaft 93 and circular carrier 81 is attached to the drive wheel through spring 96 and a bearing 84. The drive wheel has a counter weight 88 attached and, in addition, has teeth 94 that are used for stamp registration and adjustment purposes. Pulling the halves apart and twisting each half in opposite directions provides stamp location adjustment. A conventional porous through-the-stamp inking system made by Shachihata Corporation is mounted on the circumference of circular carrier 81 for stamp impressions that are registered on a copy sheet by rotating the drive wheel relative to the carrier. The inking system includes a stamp ink reservoir 82 and an integral rubber stamp 83. The inking system is operator replaceable as a whole or the inking supply or stamp can be replaced separately. A pawl 85 pivoting on the drive wheel 90 engages a latch stop 86 that is part of the copy sheet transport path. This engagement stops the print wheel after each stamp cycle and readies the wheel for the next copy sheet. The copy's lead edge which is traveling in the direction of arrow 92 in FIG. 2 lifts the pawl out of the latch stop and starts the print wheel assembly 80 rotating through contact with an O-ring 89 on drive wheel 90. The entire circumference of the drive wheel 90 is rotated through contact with the 8 " wide feeding copy sheet. As the trail edge of the copy sheet leaves the grip of the O-ring, the pawl, which is acted upon the gravity and centrifugal force, swings outward and engages the latch stop. This brings the print wheel to an abrupt stop and cocks the pawl for the next consecutively fed copy sheet. An optional flat on the O-ring allows the print wheel 80 to stay stationary until a copy sheet's lead edge disengages pawl 85.

If an operator decides no stamping is necessary, the stamping mechanism is deenergized or disengaged by a switch and solenoid or the rotation of a knob or lever or pushing a contact member on the console of the copier/printer that would cause a cam actuated pin member to engage the drive wheel 90 which in turn disables rotation of the print wheel. An optional flat on O-ring 89 allows copy sheets to pass unimpeded. The lead edges of copy sheets "walks" the pawl out of its latch when the disengagement pin is engaged. For example, the flat on the O-ring drive is shown parallel with latch stop 86. It's purpose is to allow sheets to bypass between the O-ring and latch stop 86 while the stamp wheel is held in its deactuated mode via cable/cam member 87. In this mode, incoming sheets simply enter the O-ring flat position, "walk" the pawl 85 out of the latch 86 and never come under the influence of the stamp wheel mode. During the stamping mode, member 87 is released and when the lead edge of the copy sheet trips the pawl out of the latch stop 86, counterweight 88 immediately is acted upon by gravity, which brings the lower edge of the O-ring flat corner into contact with the sheet. Once this occurs, the firmly transported sheet begins to drive the print wheel, which rolls the rubber stamp across the copy sheet.

Figure 4:
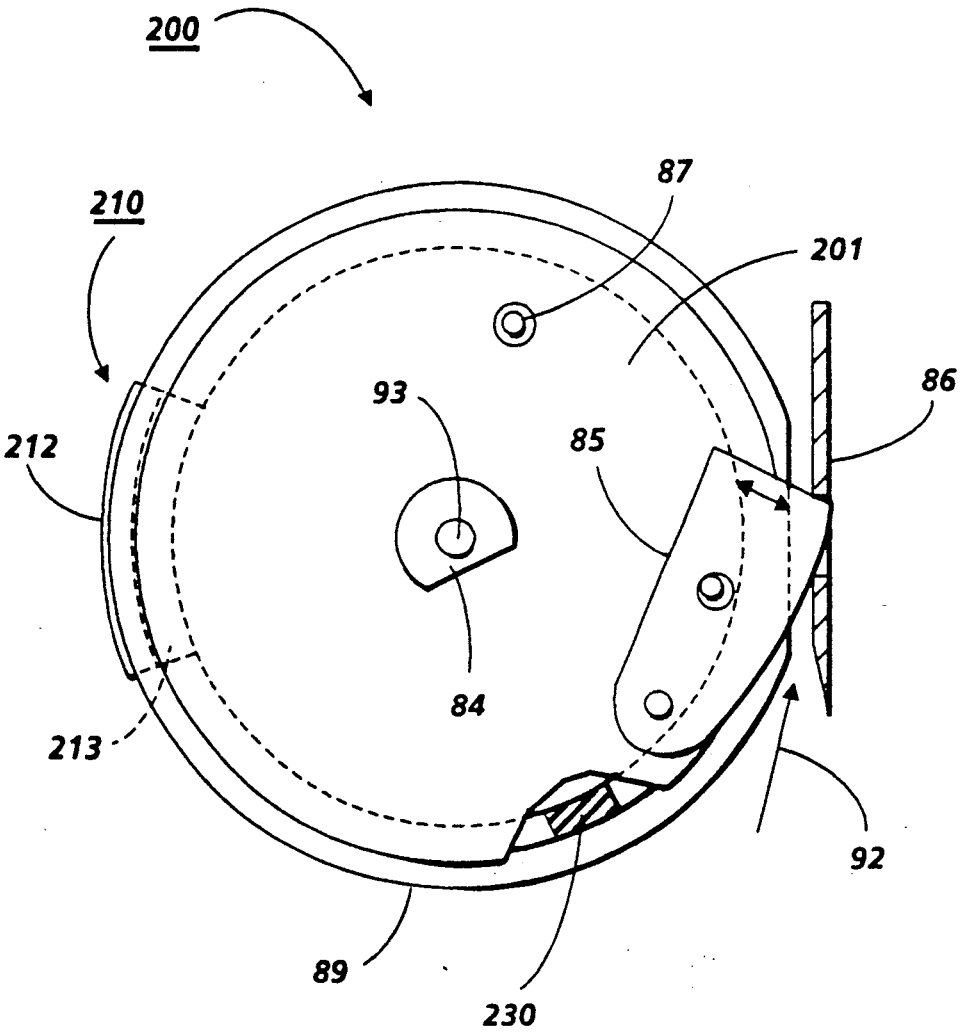
FIG. 4 is an elevational view of an alternative embodiment of the present invention.

An alternative embodiment of the present invention is shown in FIG. 4 and comprises a single piece rotary print apparatus 200 that includes a print wheel 201 that has a curved stamp holding housing 210 mounted thereon by a metal band and a counterweight 230. A rubber stamp 212 and an ink reservoir 213 are positioned within housing 210. The sheet metal or plastic band facilitates the removal or adjustment of the stamp. Print wheel 201 is mounted for rotation on a shaft 93 through spring 96 and a bearing 84. The conventional porous through-the-stamp inking system made by Shachihata Corporation is mounted on the circumference of the print wheel 201 for stamp inpressions that are accomplished by rotating the print wheel. A pawl 85 is acted upon by gravity and centrifugal force pivots on the print wheel 201 and engages a latch stop 86 that is part of the copy sheet transport path. This engagement stops the print wheel after each stamp cycle and readies the wheel for the next copy sheet. A one way clutch 97 in FIG. 3 is connected with the drive wheel such that the drive wheel will not bounce when the pawl engages. The copy's lead edge which is traveling in the direction of arrow 92 lifts the pawl out of the latch stop and starts the print wheel assembly 200 rotating through contact with an O-ring 89 on print wheel 201. The entire circumference of the drive wheel 201 is rotated through contact with the 11" wide feeding copy sheet. As the trail edge of the copy sheet leaves the grip of the O-ring, the pawl, which is acted upon by gravity and centrifugal force, swings outward and engages the latch stop. The one way clutch brings the print wheel to an abrupt stop and its inherent backlash allows the pawl cock for the next consecutively fed copy sheet. An external operator selectable cam actuated pin member is used to engaged the print wheel 201 via detent 87 and prevent rotation of the print wheel when stamping is not desired.

In recapitulation, it is apparent that a rotary ink stamp mechanism has been disclosed for use with a copier/-printer that is adapted to print selected words on copy sheets that alert a user to the unusual nature and special handling required of the text material. The rotary stamp mechanism is triggered by the lead edge of a copy sheet and deactivated by the copy sheet's trail edge. The stamping mechanism utilizes a rubber stamp on the outer surface of a wheel driven by the copy sheet to stamp a sheet. A pawl on the drive wheel is lifted by the copy sheet for stamping purposes and gravity returns the pawl to its home position. Advantages of this apparatus include the fact that it is 100% mechanical, low cost, simple customer stamp engage/disengagement, customer registration adjustment, customer stamp reinking and stamp changing, compatable with jam removal function, and useful with high speed machines. This apparatus fully satisfies the aims and advantages hereinbefore set forth and while this invention has been described in conjunction with specific embodiments thereof, it is evident that any alternatives, modifications, and variations will be apparent to those skilled in the art. Accordingly, it is intended to embrace all such alternatives, modifications, and variations as fall within the spirit and scope of the appended claims.

What is claimed is:

1. In a printing apparatus adapted to print copies of page image information onto copy sheets and forward them into an output tray, the improvement of a low-cost stamping mechanism for use in such a printing apparatus for inking a special message onto the copy sheets, comprising:

a printwheel;

stamp means positioned on a portion of the outer circumference of said printwheel;

copy sheet transport means through which a copy sheet is driven by said printwheel; and latch means including a pawl attached to said printwheel for preventing movement of said printwheel except when stamping of copy sheets is required, said pawl resting solely due to gravity in interfering relation in a cut-out portion of said copy sheet transport path means with respect to copy sheets passing through said copy sheet transport means, said pawl being lifted from said cut-out portion of said copy sheet transport path means by the leading edge of a driven copy sheet and falls solely due to gravity and centrifugal force back into said cut-out portion of said copy sheet transport path means once the trailing edge of the copy sheet passes said pawl.

2. The apparatus of claim 1, wherein said print wheel includes a drive wheel and a mating carrier wheel.

3. The apparatus of claim 2, wherein said carrier wheel has said stamp means attached to a peripheral portion thereof.

4. The apparatus of claim 3, wherein said drive wheel includes an O-ring attached to its outer circumference that is adapted to come into frictioned contact with copy sheets and rotate said drive wheel when stamping is required.

5. The apparatus of claim 4, wherein said stamp means includes an inking pad mounted on an ink reservoir.

6. The apparatus of claim 5, wherein said O-ring has a flat on its outer surface.

7. A low cost, compact rotary stamp apparatus, comprising:

a print wheel having a curved stamp holding housing attached thereto;

copy sheet transport path means through which a copy sheet is driven by said print wheel; and a pawl positioned for pivotal rotation on said print wheel and adapted to rest in a home position within a cut-out portion of said copy sheet transport path means such that movement of said print wheel is inhibited, said pawl being adapted to be lifted from said cut-out portion of said copy sheet transport path means by the leading edge of a driven copy sheet and to fall due solely to gravity and centrifugal force back into said cut-out portion of said copy sheet transport path means once the trailing edge of the copy sheet passes said pawl.

8. The rotary stamp apparatus of claim 7, including means for adjusting the position of said stamp holding housing on said print wheel.

9. The rotary stamp apparatus of claim 8, including counterweight means for positioning said print wheel.

10. The rotary stamp apparatus of claim 9, including one way clutch means connected to said print wheel in order to prevent said print wheel from bouncing when said pawl engages said latch stop.

11. The rotary stamp apparatus of claim 10, including an O-ring attached to its outer circumference that is adapted to come into frictioned contact with copy sheets and rotate said drive wheel when stamping is required.

12. The apparatus of claim 11, wherein said O-ring has a flat on its outer surface.

13. The apparatus of claim 12, wherein said stamp stamp holding housing includes an inking pad mounted on an ink reservoir.

14. The apparatus of claim 13, including means for selectively inhibiting or not inhibiting movement of said print wheel.

15. In a printing apparatus adapted to place original page image information onto a photoconductive surface and to print copies of the page image information onto copy sheets and forward them into an output tray, the improvement of a low-cost stamping mechanism for use in such a printing apparatus for inking a special message onto the copy sheets, comprising:

a multi-mode printwheel;

stamp means positioned on a portion of the outer circumference of said printwheel;

copy sheet transport means through which a copy sheet is driven by said printwheel; and latch means including a pawl attached to said printwheel for preventing movement of said printwheel except when said printwheel is in a first mode, said pawl resting solely due to gravity in contacting relation in a cut-out portion of said copy sheet transport path means with respect to copy sheets passing through said copy sheet transport means, said pawl being lifted from said cut-out portion of said copy sheet transport means by the leading edge of a driven copy sheet and falls due solely to gravity and centrifugal force back into said cut-out portion of said copy sheet transport path means once the trailing edge of the copy sheet passes said pawl, and when said printwheel is in a second mode said pawl does not prevent movement of said printwheel while simultaneously being lifted out of and returned to said cut-out portion of said transport by movement of copy sheets through said copy sheet transport means.

* * * * *